US005470164A

United States Patent [19]

Chen

[11] Patent Number: 5,470,164

[45] Date of Patent: Nov. 28, 1995

[54] PEN INCORPORATED WITH AND ILLUMINATOR

[76] Inventor: Ching C. Chen, No. 14, Alley 1, Lane 46, Hsing Erh Rd., Taoyuan City, Taiwan

[21] Appl. No.: 400,805

[22] Filed: Mar. 8, 1995

[51] Int. Cl.[6] ..... B43K 29/10

[52] U.S. Cl. ..... 401/195; 362/118

[58] Field of Search ..... 401/195; 362/118

[56] References Cited

U.S. PATENT DOCUMENTS

| | | | |
|---|---|---|---|
| 2,052,501 | 8/1936 | Thornton | 362/118 |
| 5,131,775 | 7/1992 | Chen | 401/195 |
| 5,143,465 | 9/1992 | Hou | 401/195 |

*Primary Examiner*—Steven A. Bratlie

*Attorney, Agent, or Firm*—Merchant, Gould, Smith, Edell, Welter & Schmidt

[57] ABSTRACT

A pen incorporated with an illuminator in which the positive terminal of the illuminator is connected to the positive terminal of the battery through a first switch, which is controlled by a pen top, and the negative terminal of the illuminator is connected to the negative terminal of the battery through the refill and a second switch, which is controlled by an insulative sleeve, and therefore the the illuminator is turned on when the refill is extended out of the pen for writing and the pen top is switched to the ON position; the illuminator does no work when the refill is extended out of the pen for writing and the pen top is switched to the OFF position.

1 Claim, 9 Drawing Sheets

PEN INCORPORATED WITH AND ILLUMINATOR

BACKGROUND OF THE INVENTION

The present invention relates to pens, and relates more particularly to a pen incorporated with an illuminator which automatically gives off light when the refill is extended out of the pen holder for writing after the top of the pen is turned to the ON position.

Various writing apparatus with illuminator means have been disclosed, and have appeared on the market. These writing apparatus are helpful for writing in the dark. However, because the illuminators of these writing apparatus are commonly controlled by a press-button, the battery power supply will be continuously consumed when the apparatus is put in the pocket and the press-button is depressed by error. Furthermore, because the connection between the contacts at the press-button and the two opposite ends of the battery is made through an electric circuit, the contacts at the two opposite ends of the electric circuit tend to disconnect from the battery/press button with the use of the writing apparatus.

SUMMARY OF THE INVENTION

It is one object of the present invention to provide a pen incorporated with an illuminator which automatically gives off light when used to write. It is another object of the present invention to provide a pen incorporated with an illuminator which is simple in structure and easy to assemble. It is still another object of the present invention to provide a pen incorporated with an illuminator which can be easily and positively controlled to turn on/off the illuminator without causing an error.

According to the present invention, the positive terminal of the illuminator is connected to the positive terminal of the battery through a first switch, which is controlled by a pen top, and the negative terminal of the illuminator is connected to the negative terminal of the battery through the refill and a second switch, which is controlled by an insulative sleeve. Therefore, the illuminator is turned on when the refill is extended out of the pen for writing and the pen top is switched to the ON position; the illuminator does no work when the refill is extended out of the pen for writing and the pen top is switched to the OFF position.

BRIEF DESCRIPTION OF THE DRAWINGS

FIG. 4 is similar to FIG. 3 but showing the pen top turned to the ON position, the refill extended out of the lower barrel, and the lamp head turned on;

DETAILED DESCRIPTION OF THE PREFERRED EMBODIMENT

Figure 1:
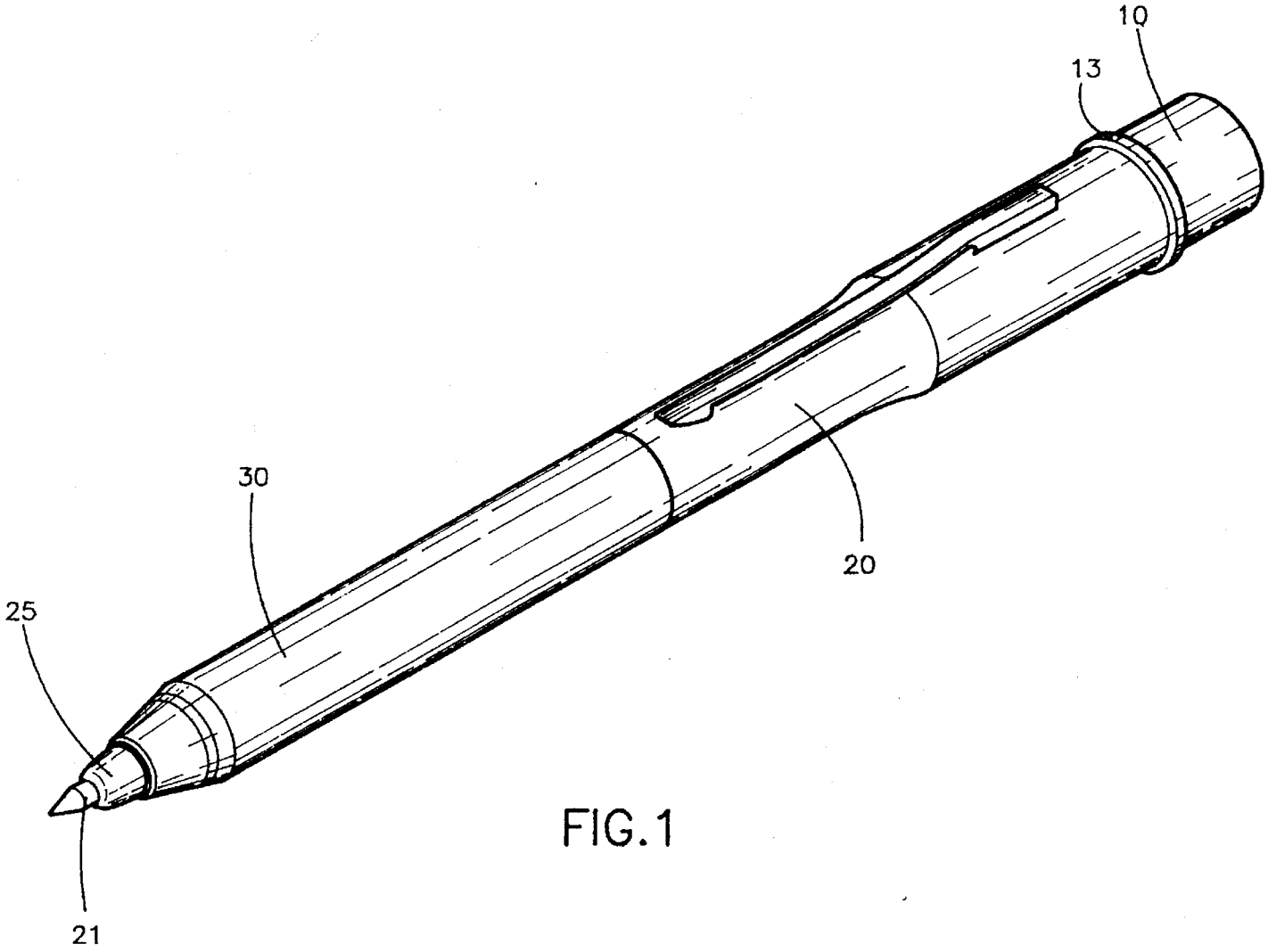
FIG. 1 is a perspective view of a pen incorporated with an illuminator according to the present invention.
Figure 2:
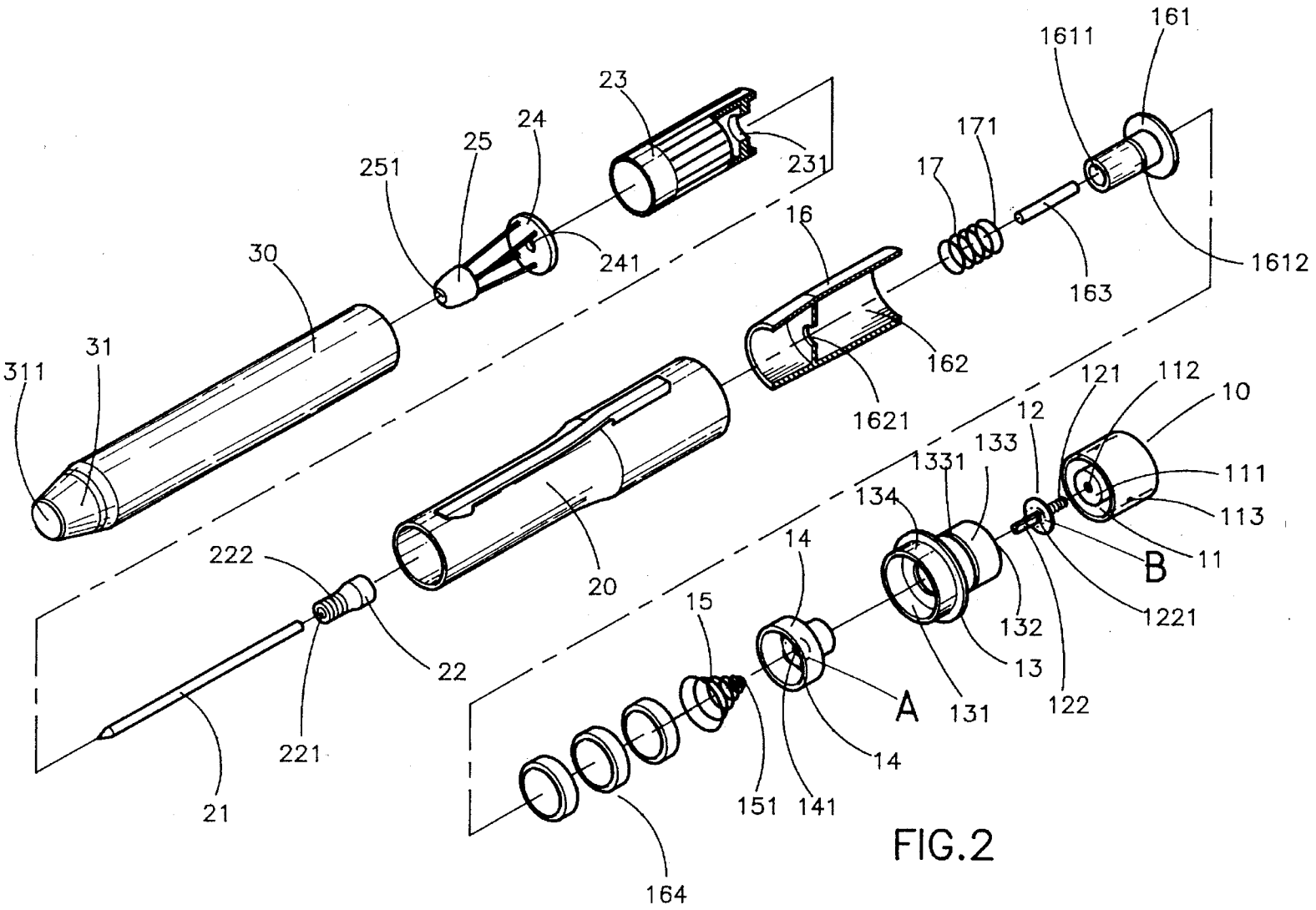
FIG. 2 is an exploded view of the pen shown in FIG. 1.
Figure 2B:
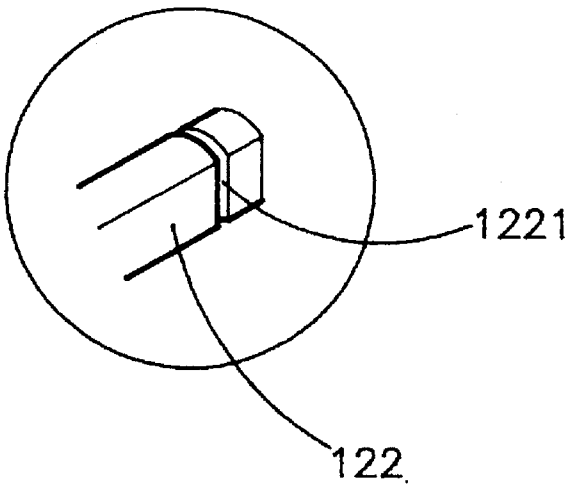
FIG. 2B is a partial view in an enlarged scale of the contact rod of the metal contact member for the pen shown in FIG. 1.
Figure 2A:
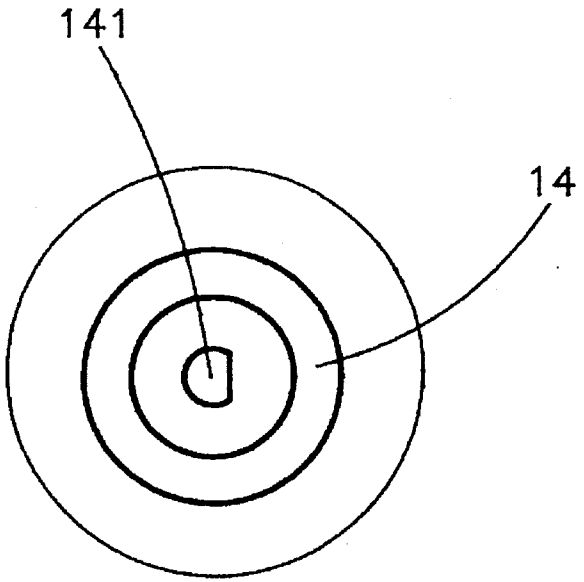
FIG. 2A is an end view of the insulative cap for the pen shown in FIG. 1.
Figure 3:
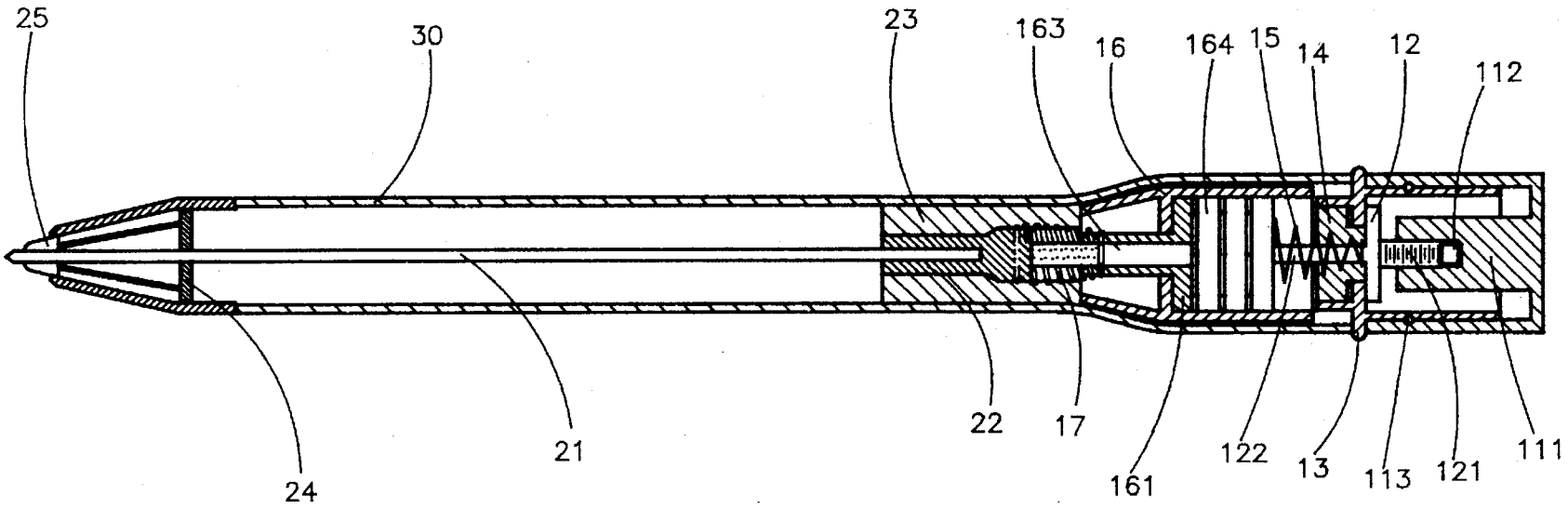
FIG. 3 is a longitudinal view in cross-section of the pen shown in FIG. 1.

Referring to FIGS. 1, 2, and 3, the insulative pen top, referenced by 10, comprises a bottom chamber 11, an inside stem 111 suspended within the bottom chamber 11, a screw hole 112 on the end of the inside stem 111, and two opposite ribs 113 raised from the periphery of the bottom chamber 11 on the inside; the metal contact member, referenced by 12, comprises a screw rod 121 at one end threaded into the screw hole 112 on the inside stem 111 of the pen top 10, and a contact rod 122 with an annular groove 1221 at an opposite end; the metal adapter, referenced by 13, comprises a bottom coupling portion 134 defining a bottom chamber 131, an upper coupling portion 133 fitted into the bottom chamber 11 of the pen top 10, an annular groove 1331 around the outside wall of the upper coupling portion 133, which receives the inside ribs 113 of the pen top, and a longitudinal center through hole 132, through which the contact rod 122 of the metal contact member 12 passes; the insulative cap, referenced by 14, is mounted within the bottom chamber 131 of the metal adapter 13, having a center through hole 141, through which the contact rod 122 of the metal contact member 12 passes; the conical metal spring, referenced by 15, is mounted within the insulative cap 14, having a top end 151 fastened to the annular groove 1221 on the contact rod 122 of the metal contact member 12; the battery holder, referenced by 16, is mounted within an upper barrel 20, comprising a battery chamber 162, which receives a battery set 164, and a bottom hole 1621 at the longitudinal center of the battery chamber 162; the T-contact, referenced by 161 is mounted within the battery chamber 162 and stopped at the battery set 164 against the conical metal spring 15, comprising a bottom tube 1611 extended out of the bottom hole 1621 on the battery chamber 162 of the battery holder 16 and an annular groove 1612 around the outside wall of the bottom tube 1611; the coil spring, referenced by 17, is mounted around the bottom tube 1611 of the T-contact 161, having a top end 171 fixed to the annular groove 1612 on the bottom tube 1611 of the T-contact 161; the insulative sleeve, referenced by 163, is mounted within the bottom tube 1611 of the T-contact 161; the refill holder, referenced by 22, is mounted within the upper barrel 20 and connected to insulative sleeve 163 and stopped at the coil spring 17 against the T-contact 161, comprising a bottom screw rod 222 and a bottom mounting hole 221 through the longitudinal center of the bottom screw rod 222; the refill, referenced by 21 is fitted into the bottom mounting hole 221 on the bottom screw rod 222 of the refill holder 22; the lower barrel, referenced by 30 is longitudinally connected to the upper barrel 20, having a tapered front end 31 defining a front orifice 311; the propelling control member, referenced by 23, is mounted within the upper barrel 20 around the refill holder 22, having a top screw hole 231, which receives the bottom screw rod 222 of the refill holder 22; the circuit board, referenced by 24, comprises a positive contact terminal (not shown) welded to the inside wall of the lower barrel 20 and electrically connected to the positive terminal of the battery set 164, a center through hole 241, through which the refill 21 passes, and a negative contact terminal (not shown) made within the center through hole 241 and disposed in contact with the refill 21; the lamp head 25 (LED or the like) is electrically connected to the circuit board 24 and extended out of the front orifice 311 of the lower barrel 30, having a center through hole 251, through which the refill 21 passes.

Figure 4:
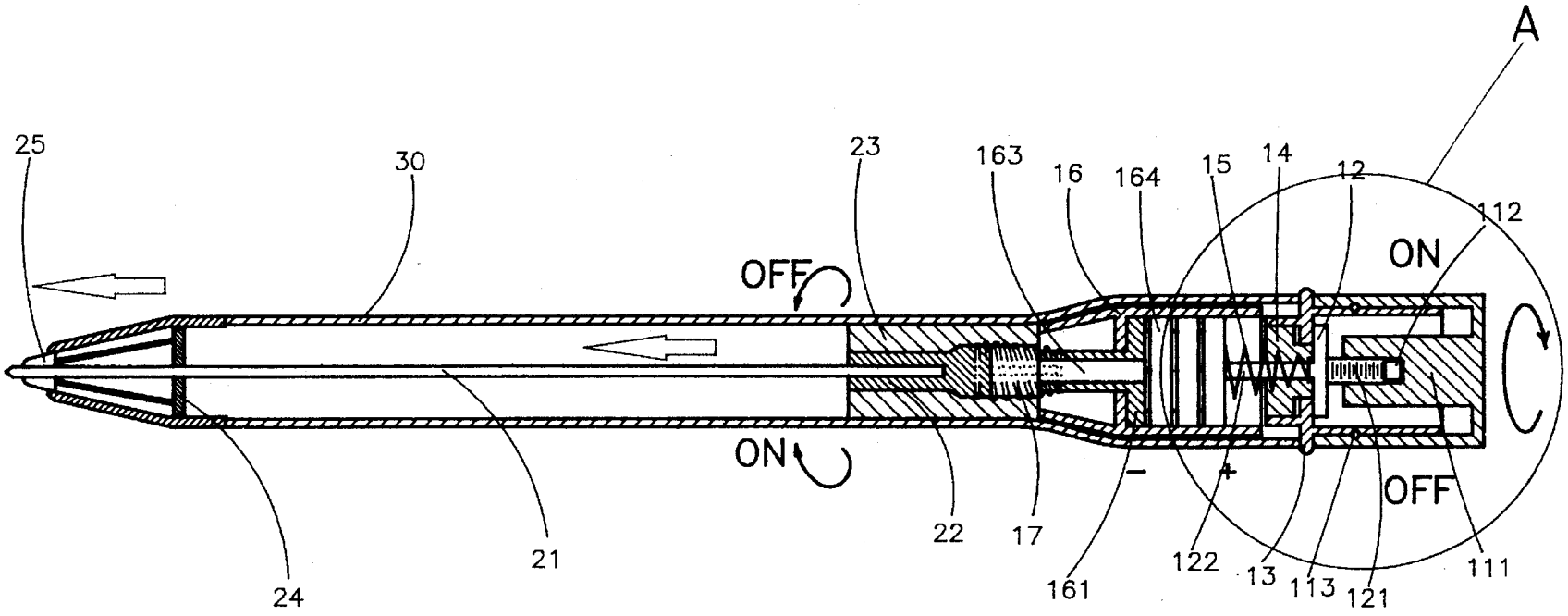
Figure 4A:
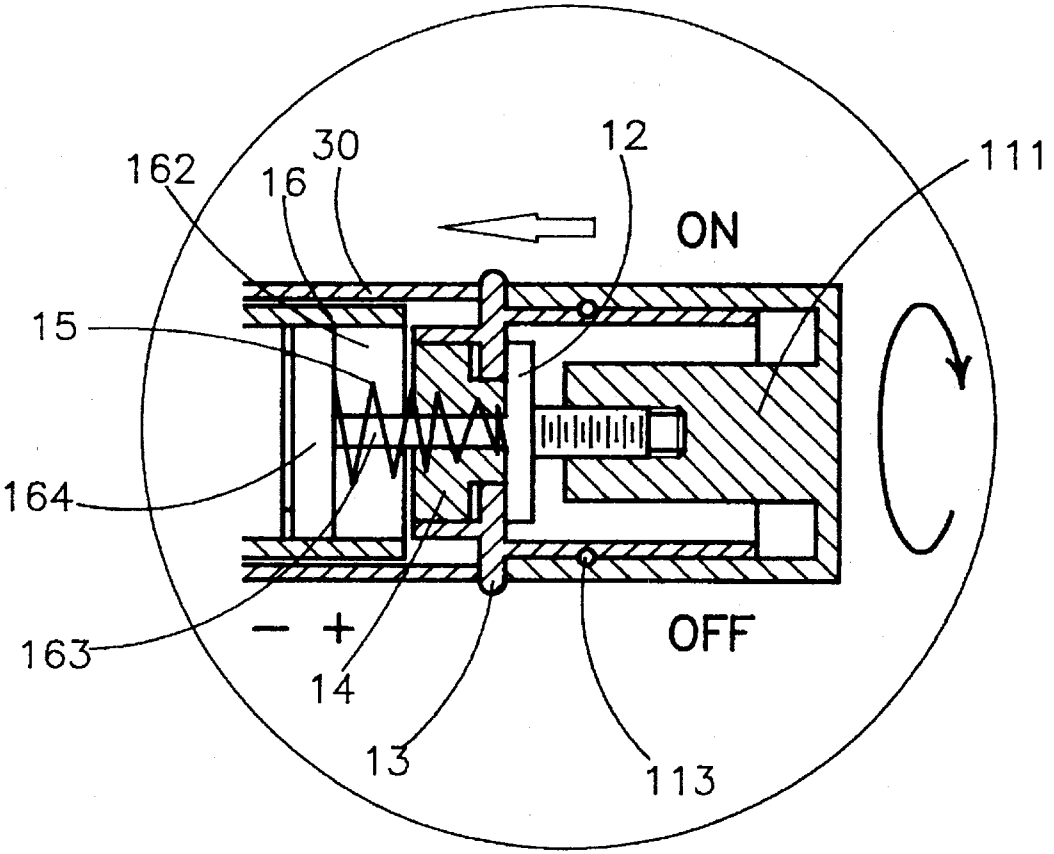
FIG. 4A is an enlarged view of detail A of FIG. 4.
Figure 5:
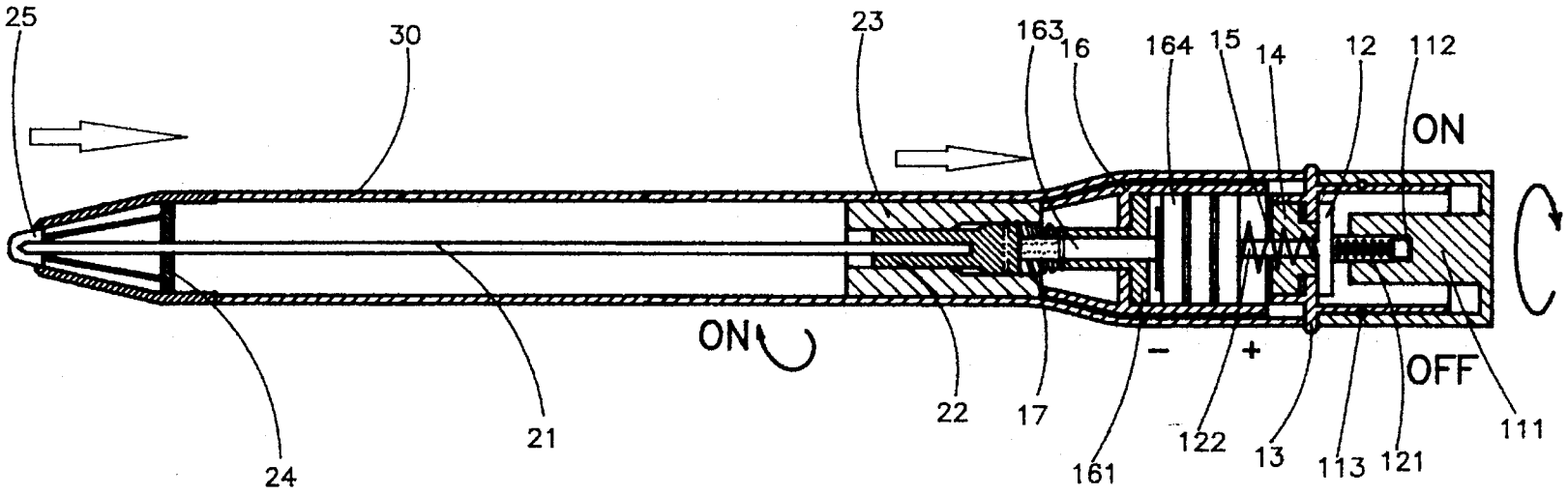
FIG. 5 is similar to FIG. 3 but showing the pen top turned to the ON position, the refill received back inside the lower barrel, and the lamp head turned off.
Figure 6:
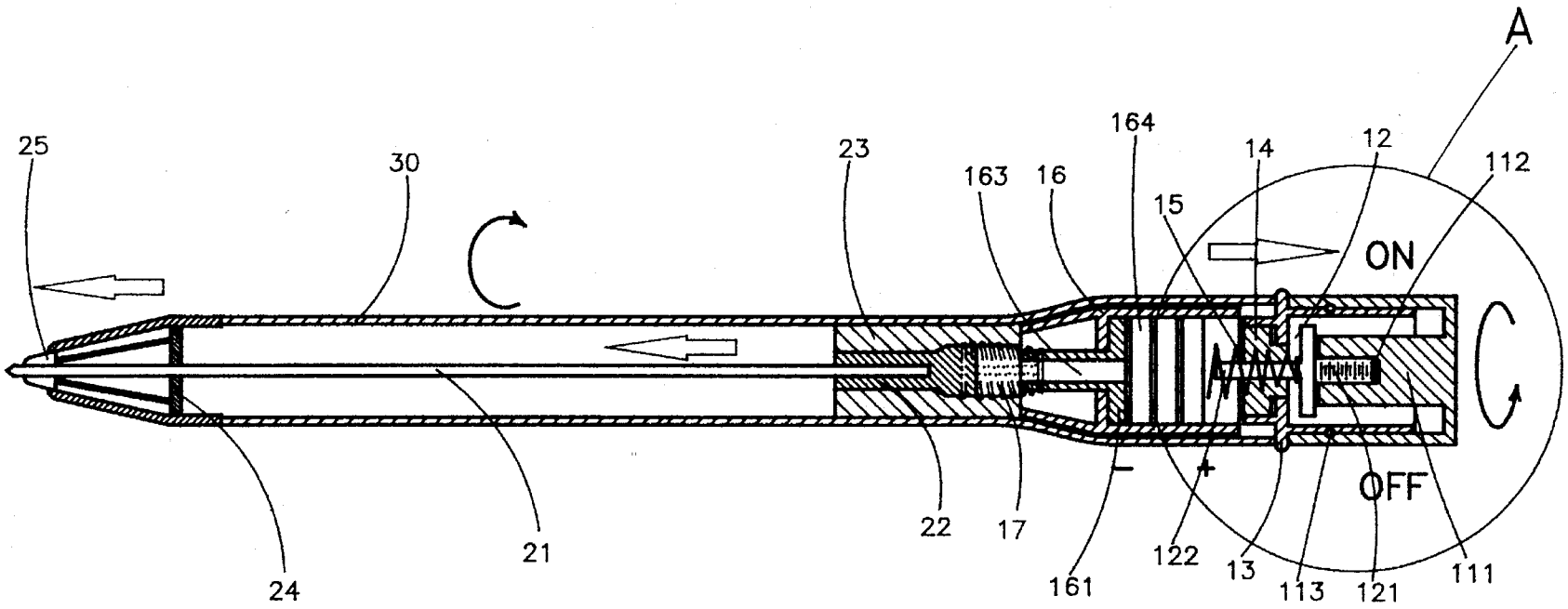
FIG. 6 is similar to FIG. 3 but showing the pen top turned to the OFF position, the refill extended out of the lower barrel, and the lamp head turned off.
Figure 6A:
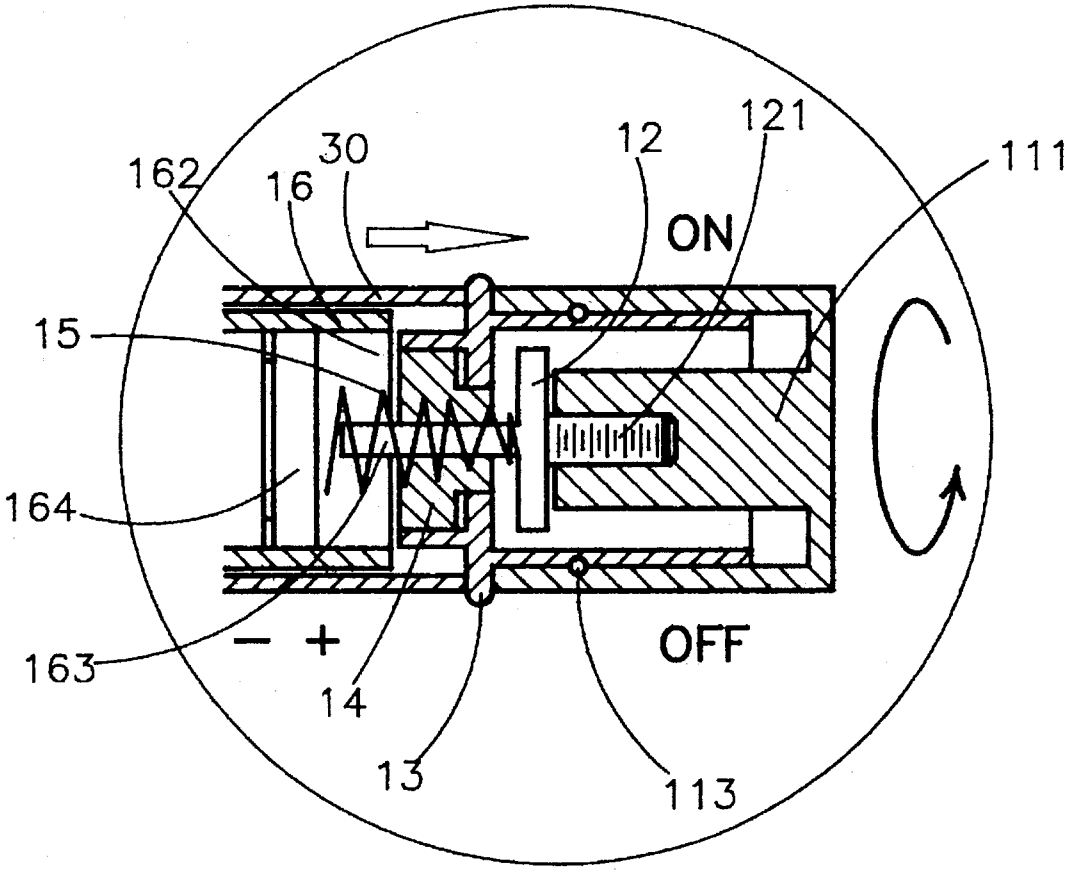
FIG. 6A is an enlarged view of detail A of FIG. 6.

Referring to FIGS. 4, 5, and 6, when the pen head 10 is turned in one direction relative to the metal adapter 13 to the "ON" position, the positive terminal of the battery set 164 is connected to the contact rod 122 of the metal contact member 12 and the metal adapter 13 through the metal conical spring 15, then the upper barrel 20 is turned counter-clockwise relative to the lower barrel 30 to drive the propelling control member 23, causing it to extend the refill 21 out of the front orifice 311 of the lower barrel 30 for writing. When the refill 21 is extended out of the lower barrel 30, the insulative sleeve 163 is separated from the negative terminal of the battery set 164, causing the lamp head 25 to be turned on. If the upper barrel 30 is turned clockwise, the propelling control member 23 is driven to lift the refill 21 back inside the lower barrel 30, causing the insulative sleeve 163 to stop against the negative terminal of the battery set 164 again, and therefore the lamp head 25 is turned off. Therefore, even if the pen top 10 is turned to the "ON" position, the lamp head 25 will be turned off when the refill 21 is received back inside the lower barrel 30. If the pen top 10 is turned back to its former "OFF" position, when the propelling control member 23 is turned by the upper barrel 20 in the counter-clockwise direction relative to the lower barrel 30, the refill 21 is extended out of the lower barrel 30 for writing, and the lamp head 25 does not work.

It is to be understood that the drawings are designed for purposes of illustration only, and are not intended as a definition of the limits and scope of the invention disclosed.

What is claimed is:

1. A pen comprising:

an insulative pen top, having a bottom chamber, an inside stem suspended within the bottom chamber, a screw hole on said inside stem, and two opposite ribs raised from said bottom chamber on the inside;

a metal contact member, having a screw rod at one end threaded into the screw hole on said inside stem of said pen top, and a contact rod at an opposite end, the contact rod of said metal contact member having an annular groove around the periphery;

a metal adapter, having a bottom coupling portion defining a bottom chamber, an upper coupling portion fitted into the bottom chamber of said pen top, an annular groove around an outside wall of said upper coupling portion, which receives the inside ribs of said pen top, and a longitudinal center through hole, through which the contact rod of said metal contact member passes;

an insulative cap mounted within the bottom chamber of said metal adapter, having a center through hole, through which the contact rod of said metal contact member passes;

a conical metal spring mounted within said insulative cap, having a top end fastened to the annular groove on the contact rod of said metal contact member;

a battery holder mounted within an upper barrel, having a battery chamber, which receives a battery set, and a bottom hole at the longitudinal center of said battery chamber;

a T-contact mounted within said battery chamber and stopped at said battery set against said conical metal spring, having a bottom tube extended out of the bottom hole on the battery chamber of said battery holder and an annular groove around the bottom tube;

a coil spring mounted around the bottom tube of said T-contact, having a top end fixed to the annular groove on the bottom tube of said T-contact;

an insulative sleeve mounted within the bottom tube of said T-contact;

a refill holder mounted within said upper barrel and connected to said insulative sleeve and stopped at said coil spring against said T-contact, having a bottom screw rod and a bottom mounting hole through the longitudinal center of the bottom screw rod;

a refill fitted into the bottom mounting hole on the bottom screw rod of said refill holder;

a lower barrel longitudinally connected to said upper barrel, having a tapered front end defining a front orifice;

a propelling control member mounted within said upper barrel around said refill holder, having a top screw hole, which receives the bottom screw rod of said refill holder;

a circuit board having a positive contact terminal around the border welded to said lower barrel on the inside and electrically connected to the positive terminal of said battery set, a center through hole, through which said refill passes, and a negative contact terminal made within the center through hole and disposed in contact with said refill; and a lamp head electrically connected to said circuit board and extended out of the front orifice of said lower barrel, having a center through hole, through which said refill is moved in and out;

wherein said pen top can be turned relative to said adapter between the ON position to let the positive terminal of said battery set be connected to the contact rod of said metal contact member and said metal adapter through said metal conical spring and the OFF position to electrically disconnect the positive terminal of said battery set from the contact rod of said metal contact member and said metal adapter; said lamp head is turned on when said refill is propelled out of said lower barrel by said propelling control member by turning said upper barrel in one direction relative to said lower barrel when said pen top is turned to the ON position, or turned off when said refill is moved back inside said lower barrel by said propelling control member by turning said upper barrel in the reverse direction relative to said lower barrel.

* * * * *

UNITED STATES PATENT AND TRADEMARK OFFICE
CERTIFICATE OF CORRECTION

PATENT NO. : 5,470,164

DATED : November 28, 1995

INVENTOR(S) : Chen

It is certified that error appears in the above-identified patent and that said Letters Patent is hereby corrected as shown below:

On the title page, item:

[54], Title "And" should read --An--

Col. 1, line 1 "And" should read --An--

Col. 1, line 29 insert --things-- after the word "write"

Signed and Sealed this

Twenty-eighth Day of January, 1997

*Attest:*

Bruce Lehman

BRUCE LEHMAN

*Attesting Officer*

*Commissioner of Patents and Trademarks*